US006716390B2

(12) United States Patent
Bekki et al.

(10) Patent No.: US 6,716,390 B2
(45) Date of Patent: Apr. 6, 2004

(54) ALUMINUM ALLOY EXTRUDED MATERIAL FOR AUTOMOTIVE STRUCTURAL MEMBERS

(75) Inventors: Yoichiro Bekki, Tokyo (JP); Noboru Hayashi, Wako (JP)

(73) Assignees: The Furukawa Electric Co., Ltd., Tokyo (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/738,048

(22) Filed: Dec. 15, 2000

(65) Prior Publication Data

US 2001/0006607 A1 Jul. 5, 2001

(30) Foreign Application Priority Data

Dec. 17, 2000 (JP) ..... 11-359950

(51) Int. Cl.[7] ..... C21C 21/02

(52) U.S. Cl. ..... 420/532; 420/545; 420/549; 420/535

(58) Field of Search ..... 420/535, 541, 420/545, 549, 532

(56) References Cited

U.S. PATENT DOCUMENTS 4,409,036 A * 10/1983 Vernam et al. ..... 148/551
6,355,090 B1 * 3/2002 Ohyama et al. ..... 75/687

FOREIGN PATENT DOCUMENTS

| | | |
|---|---|---|
| GB | 605 282 | 7/1948 |
| JP | 58-031055 | 2/1983 |
| JP | 61-190051 | 8/1986 |
| JP | 3-62610 | 6/1991 |
| JP | 05-271834 | 10/1993 |
| JP | 08-025874 | 1/1996 |
| JP | 08-209277 | 8/1996 |
| JP | 09-256095 A * | 9/1997 |
| JP | 11-172390 | 6/1999 |
| JP | 11-286759 | 10/1999 |
| JP | 11-2866759 | 10/1999 |
| JP | 2000-063972 | 2/2000 |
| JP | 2000-063973 | 2/2000 |
| JP | 2000-033933 | 11/2000 |
| JP | 2000-313931 | 11/2000 |
| JP | 2000-313933 | 11/2000 |
| WO | WO99/53110 | 10/1999 |
| WO | WO99/60181 | 11/1999 |

OTHER PUBLICATIONS

Ooyama, K., et al., Development of wrought aluminum alloy made from cast aluminum scraps, Lecture Abstracts of Spring Meeting No. 98, pp. 73–74, The Japan Institute of Light Metal, May 2000.

Kashiwazaki, K., et al., Development of extruded aluminum alloy made from cast scraps, Lecture Abstracts of Autumn Meeting No. 99, pp. 79–80, The Japan Institute of Light Metal, Nov. 2000.

* cited by examiner

*Primary Examiner*—Roy King
*Assistant Examiner*—Janelle Combs Morillo
(74) *Attorney, Agent, or Firm*—Knobbe Martens Olson & Bear LLP

(57) ABSTRACT

An aluminum alloy extruded material for automotive structural members, which contains 2.6 to 5 wt % of Si, 0.15 to 0.3 wt % of Mg, 0.3 to 2 wt % of Cu, 0.05 to 1 wt % of Mn, 0.2 to 1.5 wt % of Fe, 0.2 to 2.5 wt % of Zn, 0.005 to 0.1 wt % of Cr, and 0.005 to 0.05 wt % of Ti, and satisfies relationship of the following expression (I), (Content of Mn (wt %))+0.32×(content of Fe (wt %))+0.097×(content of Si (wt %))+3.5×(content of Cr (wt %))+2.9×(content of Ti (wt %))≦1.36 (I) with the balance being made of aluminum and unavoidable impurities. A method of producing the aluminum alloy extruded material for automotive structural members, which comprises cooling with a refrigerant from outside of a die-exit side, at the time of extrusion.

3 Claims, No Drawings

ALUMINUM ALLOY EXTRUDED MATERIAL FOR AUTOMOTIVE STRUCTURAL MEMBERS

FIELD OF THE INVENTION

The present invention relates to an aluminum alloy extruded material for automotive structural members, such as a frame or a beam, which is excellent in mechanical strength, fatigue strength, toughness, weldability, and extrusion property. The present invention also relates to a production method of the aluminum alloy extruded material.

BACKGROUND OF THE INVENTION

Hitherto, 6000-series alloys, such as JIS 6061 alloy, 6N01 alloy, or 6063 alloy, have been generally used as an aluminum alloy extruded material for automotive structural members, such as a shape (product) for a space frame. However, these alloys require an extremely large electric current in performing spot welding, raising a problem that the welding electrode tip life decreases. Further, since these alloys have a low degreasing property and a low chemical conversion property, it has been difficult to apply a coat having good durability onto these alloys.

As characteristics desired in extruded materials for automotive structural members, there are, for example, ease in extrusion of a hollow cross section, high mechanical strength, high elongation, high bending processability, and excellent fatigue property, in addition to the aforesaid spot weldability, and surface treatment properties, such as degreasing property and chemical conversion property.

Further, in recent years, from the view-point of environmental problems and effective utilization of resources, the importance of recycling used products is increasing, and also there is movement to legislate the obligation to recollect automobile parts, and various studies are carried out on the reutilization of metal scrap. Particularly among these, the establishment of a technique for reproducing high-quality materials from scrap of discarded automobiles and others, is eagerly desired. For this reason, an excellent recycling property is a characteristic that will become more important in aluminum alloy materials.

Also, toughness of a certain degree is required, to sustain a load as an automotive structural member.

However, as described below, the conventional materials do not have these characteristics at the same time.

(i) For example, JP-A-58-31055 ("JP-A" means unexamined published Japanese patent application) discloses an aluminum alloy for a structure with improved mechanical strength, weldability, and cutting ability, which contains 2.3 to 6 wt % of Si, 0.4 to 1.0 wt % of Mg, 0.4 to 1.0 wt % of Mn, and small amounts of Zn and Sn, with the balance being made of Al. However, the bending processability and spot weldability of the alloy are insufficient, and the alloy is greatly different from one for use in the present invention, in that the alloy is not one containing both elements of Cu and Zn, to lower the melting point of the aluminum alloy, with improved spot weldability and chemical conversion property at the time of pre-treatment, such as coating (adhesion property of zinc phosphate).

(ii) Further, JP-A-61-190051 discloses a method of producing an Al-series hollow extruded shape material, in which use is made of an Al alloy containing 5 to 15 wt % of Si, and up to 1.0 wt % of Mg, having an Fe content of not more than 0.5 wt %, and containing not more than 0.25 wt % of Cu, Mn, and other elements. However, this Al alloy has a larger amount of added Si than the present invention, with improved heat resistance and abrasion resistance properties, and it is used as a high-temperature exposure member, or as a thick extruded material or rod material for sliding members of an automobile. Further, it has low spot weldability and a low surface treatment property, such as the adhesion property of zinc phosphate, and it has an insufficient extrusion property. Therefore, this material cannot be used as an automotive structural member, like the present invention can.

(iii) Further, JP-A-5-271834 discloses an aluminum alloy containing 0.2 to 1.2 wt % of Mg and 1.2 to 2.6 wt % of Si, having a value of {Si (wt %)−Mg (wt %)/1.73} exceeding 0.85 and being less than 2.0, with the balance being made of Al, and having fine recrystallized grains and a stable artificial aging property. This alloy enables easier generation of $Mg_2Si$, by allowing the compositional ratio of Mg and Si to be on the Si-excessive side than the stoichiometric composition, and this alloy merely has increased component ranges of Mg and Si with respect to the compositions of conventional JIS 6N01 alloy or AA6005 alloy.

(iv) Furthermore, JP-A-8-25874 discloses an aluminum alloy extruded material for automotive structural members, which contains 0.5 to 2.5 wt % of Si, 0.2 to 1.0 wt % of Fe, 0.45 to 1.5 wt % of Zn, 0.05 to 1.0 wt % of Cu, and 0.4 to 1.5 wt % of Mn. Although this extruded material is excellent in extrusion property, mechanical strength, and surface treatment property, it has low electric resistance of the material, and it has a problem in spot weldability. In other words, in the spot welding of car body structural members of an automobile on a mass production line, the wear and loss of the electrode tip for welding are problems. If the wear and loss of the electrode tip get larger and larger, the structure of the welded part becomes unstable, and the nugget dimension changes, to lower the strength of the welded part, so that exchange of electrode tips must be frequently carried out. This is the greatest factor in disturbing productivity on a mass production line, and the life of the electrode tip for welding is the greatest problem involved in spot weldability.

SUMMARY OF THE INVENTION

In one aspect of the present invention, an aluminum alloy extruded material for automotive structural members is provided. Advantageously, the aluminum alloy extruded material includes 2.6 to 5 wt % of Si, 0.15 to 0.3 wt % of Mg, 0.3 to 2 wt % of Cu, 0.05 to 1 wt % of Mn, 0.2 to 1.5 wt % of Fe, 0.2 to 2.5 wt % of Zn, 0.005 to 0.1 wt % of Cr, and 0.005 to 0.05 wt % of Ti, and satisfies the relationship of the following expression (I): expression (I) (Content of Mn (wt %))+0.32×(content of Fe (wt %))+0.097×(content of Si (wt %))+3.5×(content of Cr (wt %))+2.9×(content of Ti (wt %))≦1.36.

In one aspect of the invention, this aluminum alloy extruded material for automotive structural members is made with automotive part scrap with at least a portion comprising about 1.5 to 14 wt % of Si.

DETAILED DESCRIPTION OF THE INVENTION

In view of the aforesaid problems, the present inventors have made eager studies by having an eye to a phenomenon that appears by composite action of plural elements, in addition to the effect that each element of an aluminum alloy material exhibits individually and singly. One of such phenomena is crystallization of an intermetallic compound composed of plural kinds of constituent elements, which decreases the bending property and toughness. Conventionally, studies are made on a relationship of the content of each element constituting a giant intermetallic compound, in an alloy composition in which the generation of giant intermetallic compound is small. As a result of studies, the present inventors have found that, unlike the conventional reports, the content of Si which is not a constituent element of the intermetallic compound gives an influence on this phenomenon in the generation of an intermetallic compound containing Mn, Fe, Cr, and Ti, and that an aluminum alloy extruded material preferable as an automotive structural member can be obtained, which material has each of the aforesaid physical properties if these elements satisfy a specific relationship such as described below. The present invention has been made based on these findings.

That is, according to the present invention there is provided:

(1) An aluminum alloy extruded material for automotive structural members, containing 2.6 to 5 wt % of Si, 0.15 to 0.3 wt % of Mg, 0.3 to 2 wt % of Cu, 0.05 to 1 wt % of Mn, 0.2 to 1.5 wt % of Fe, 0.2 to 2.5 wt % of Zn, 0.005 to 0.1 wt % of Cr, and 0.005 to 0.05 wt % of Ti, and satisfying relationship of the following expression (I), with the balance being made of aluminum and unavoidable impurities:

$$(\text{Content of Mn (wt \%)})+0.32\times(\text{content of Fe (wt \%)})+0.097\times(\text{content of Si (wt \%)})+3.5\times(\text{content of Cr (wt \%)})+2.9\times(\text{content of Ti (wt \%)})\leqq 1.36; \quad \text{expression (I)}$$

(2) The aluminum alloy extruded material for automotive structural members according to the above (1), wherein said aluminum alloy further contains at least one element selected from the group consisting of Na, Sr, and Sb, each at a content of 50 to 500 ppm;

(3) A method of producing the aluminum alloy extruded material for automotive structural members according to the above (1) or (2), comprising cooling with a refrigerant from outside of a die-exit side, at the time of extrusion; and (4) A method of producing the aluminum alloy extruded material for automotive structural members according to the above (1) or (2), comprising using an automobile aluminum part scrap, which contains 1.5 to 14 wt % of Si, in at least a part of an aluminum alloy ingot.

Hereinafter, the inventions of the above (1) to (4) are referred to as the first embodiment, the second embodiment, the third embodiment, and the fourth embodiment of the present invention, respectively.

Herein, the present invention means to include all of the first embodiment, the second embodiment, the third embodiment, and the fourth embodiment, unless otherwise specified.

Herein, the "outside of a die-exit side" in the third embodiment means a part of a surface of the die on the support tool side (for example, the side where the backer, the bolster, or the like is present) which is not in direct contact with the extruded material (aluminum alloy). Herein, the "aluminum alloy extruded material" is a product of extrusion and is utilized for processing into a final product.

The first embodiment will be described.

Since the mechanical strength of the aluminum alloy to be used in the present invention is obtained mainly by aging precipitation of $Mg_2Si$, Mg and Si are essential elements.

By being contained excessively from the stoichiometric amount with respect to the needed amount of $Mg_2Si$, Si increases the processing hardening property, increases the elongation, and forms dense clusters at an early stage of the aging precipitation, so that the effect of increasing the mechanical strength is large. Moreover, since the rise of the deformation resistance at the time of extrusion is small, Si acts an important role in satisfying all of the extrusion property, the mechanical strength, and the elongation. If Si is lower than 2.6 wt %, these effects are insufficient, and it is difficult to recycle and use automobile scraps made of casts containing a large amount of Si. On the other hand, if Si exceeds 5 wt %, the eutectic Si that crystallizes at the time of casting becomes large in amount, thereby deteriorating the toughness (a method by a Charpy value is representative as a method of evaluating the toughness).

Therefore, in the present invention, Si is allowed to be contained at 2.6 to 5 wt %.

Mg is essential for aging precipitaion of $Mg_2Si$. If Mg is less than 0.15 wt %, a sufficient mechanical strength is not obtained. On the other hand, if Mg exceeds 0.3 wt %, the deformation resistance will be too large, whereby the extrusion property is deteriorated, as well as the difference of mechanical strength between the matrix and the non-precipitated zone of the vicinity of grain boundary will be too large after aging, and the tendency of the intergranular breaking increases, to lower the bending property and the toughness. Therefore, Mg is allowed to be contained at 0.15 to 0.3 wt %.

Cu mainly acts to strengthen the solid solution and has an effect of increasing the mechanical strength and the ductility, and further improves the surface treatment property, such as the degreasing property and the chemical conversion property. If Cu is less than 0.3 wt %, these effects are not fully exhibited, and it is difficult to recycle and use the automobile scraps (For example, the automobile part scraps of JIS ADC-12 usually contain 1.5 to 3 wt % of Cu). If Cu exceeds 2 wt %, the corrosion resistance is deteriorated, and the deformation resistance will be too large, and also the extrusion property decreases. Therefore, Cu is contained at 0.3 to 2 wt %.

Mn and Fe have an effect of increasing the mechanical strength and restraining the grain growth. If Mn is less than 0.05 wt %, these effects are not sufficient, and if it exceeds 1 wt %, the deformation resistance becomes large and the extrusion property decreases. If Fe is less than 0.2 wt %, these effects are likewise insufficient, whereas if it exceeds 1.5 wt %, the deformation resistance increases, the extrusion property decreases, and the corrosion resistance is deteriorated. Therefore, Mn is allowed to be contained at 0.05 to 1 wt %, and Fe is allowed to be contained at 0.2 to 1.5 wt %.

Zn has a function of improving the surface treatment property, such as the degreasing property and the chemical conversion property, without increasing the deformation resistance. If Zn is less than 0.2 wt %, this effect is insufficient, whereas if it exceeds 2.5 wt %, the corrosion resistance is deteriorated. Therefore, Zn is allowed to be contained at 0.2 to 2.5 wt %.

Cr has a function of increasing the mechanical strength and forming finer recrystallized grains. If Cr is less than 0.005 wt %, these effects are small, whereas if it exceeds 0.1 wt %, these effects will be saturated and the bending processability will be deteriorated. Therefore, Cr is allowed to be contained at 0.005 to 0.1 wt %.

Ti has a function of forming finer recrystallized grains at the time of casting. If Ti is less than 0.005 wt %, this effect is small, whereas if it exceeds 0.05 wt %, this effect will be saturated and the bending processability will be deteriorated. Therefore, Ti is allowed to be contained at 0.005 to 0.05 wt %.

Further, in the present invention, in addition to the requirement that the content of each of the aforesaid elements is individually within the aforesaid range, the contents of Mn, Fe, Cr, Ti, and Si satisfy the relationship of the following expression (I).

$$(\text{Content of Mn (wt \%)})+0.32\times(\text{content of Fe (wt \%)})+0.097\times(\text{content of Si (wt \%)})+3.5\times(\text{content of Cr (wt \%)})+2.9\times(\text{content of Ti (wt \%)})\leqq 1.36 \quad \text{expression (I)}$$

According to the studies by the present inventors, there is a possibility of generation of an intermetallic compound containing Mn, Fe, Cr, and Ti, in an alloy having a composition such that the content of each element is within the aforesaid range. Unlike the conventional reports, the content of Si which is not a constituent element of the intermetallic compound gives an influence on the generation of the intermetallic compound. This is assumed to be because, if the content of Si increases, the liquidus temperature and the solidus temperature decrease, to increase the possibility of the generation of a giant intermetallic compound. The aforesaid expression (I) shows a relationship in the composition that can restrain the generation of intermetallic compounds that lower the bending property or the toughness, by taking this influence of Si into account as well.

The second embodiment will be described.

In the aluminum alloy extruded material of the second embodiment, the aluminum alloy further contains at least one element selected from the group consisting of Na, Sr, and Sb. Na, Sr, and Sb are known to form spherical Si particles in the cast products. In the present invention, they also have an effect in the improvement of the shape of the Si particles that deteriorate the toughness. Such an effect is especially large if the extrusion ratio is small and the grinding of the Si particles by processing is not carried out sufficiently. Particularly, if the extrusion ratio is smaller than or equal to 15, these elements can be preferably allowed to be contained.

Na, Sr, and Sb can be used in one kind or in two or more kinds. If the amount of each to be used is less than 50 ppm, the intended effect is small, whereas if it exceeds 500 ppm, the intercrystalline cracking are liable to occur at the time of extrusion. Therefore, when these are to be used, they are used each at an amount of 50 to 500 ppm.

The extruded material of the present invention shows good characteristics even if it is produced by a usual method, but the third embodiment and the fourth embodiment can be mentioned as a preferable production method for improving the productivity and the recycling property.

The third embodiment mainly contributes to an improvement of the productivity. Since the aluminum alloy for use in the extruded material of the present invention has a relatively large content of Si, there arises a problem of the cracking and the deterioration of the surface roughness accompanying the melting of the eutectic Si, if the extrusion speed is simply increased. To this, the present inventors have found that cooling near the die-bearing is effective, and further that cooling from the outside, on the die-exit side, aiming at the control of the die temperature is the most effective. In other words, if liquid nitrogen or the like is allowed to flow in the inside of the die or between the die and the backer, to be jetted to the bearing-exit side of the die and cooled, as in the conventional cases, the material (aluminum alloy) near the die in the container is also cooled, and the extrusion pressure becomes too large. In contrast, by providing a piping from the outside and directly cooling the outside surface of the die, the improvement in cracking and roughness can be achieved, without making the extrusion pressure too large. For cooling, in addition to liquid nitrogen and others that are conventionally used, a refrigerant, such as air, water mist, or water, can be suitably selected and used in accordance with the required cooling capability. Use of water mist or water shower is preferable, in view of the cooling capability and the cost. Further, it is effective to cool the extruded aluminum alloy itself immediately after the extrusion exit, in addition to the outside of the die, due to excellent thermal conductivity of aluminum. A more effective cooling can be carried out by using both of the above in combination. The degree of cooling can be suitably determined for obtaining a good extruded state (improvement in cracking and roughness), without increasing the extrusion pressure too much, at a desired extrusion speed.

The fourth embodiment is a method of producing the extruded material of the present invention that makes it easy to recycle from an automobile to an automobile, by using an automotive aluminum part scrap in a part or a whole of the raw material. As the automotive aluminum part scraps, cast products, such as die-cast parts (JIS ADC-12 and others) and GDC (mold-cast) parts (JIS AC-4CH and others) of an engine block or the like, are representative. Since the aluminum alloy extruded material of the present invention has a relatively large content of Si, these cast scraps can be easily used.

Further, aluminum parts of air conditioners, radiators, and others, are generally produced by blazing, and a high-Si material used as a skin (clad) material remains, so that recycling has been conventionally difficult. However, according to the present invention, these can be easily utilized in the same manner as the cast product scraps.

When an automotive aluminum part scrap is to be used as a part (preferably not less than 30 wt %) or a whole of the raw material of the extruded material of the present invention, those having an Si content of preferably 1.5 to 14 wt %, more preferably 3 to 9 wt %, are used. The automotive aluminum part scraps can be used as they are, or after being subjected to component adjustment using an α-phase (solid solution) separating treatment or the like.

The aluminum alloy extruded material for automotive structural members of the present invention exhibits such excellent effects of being excellent in fatigue strength and surface treatment property, having a high toughness, tensile strength, and bending processability, generating no cracking by a bending process of high degree, and giving small wear and loss of a welding electrode tip in spot welding. This aluminum alloy extruded material can be preferably used as an automotive structural member with uses that require spot weldability and surface treatment property as well as bending processability, such as a side frame, a rear frame, a center pillar, a side sill, and a floor frame.

According to the production method of the present invention, the extruded material having less cracking can be produced with a high productivity and at a high extrusion speed. Further, the aluminum alloy extruded material for automotive structural members of the present invention can be produced with a high quality and at a low cost by using automotive aluminum part scraps or the like.

The present invention will be described in more detail on the basis of the following examples, but the present invention is not limited to these examples.

EXAMPLE

Example 1

As shown in Table 3, aluminum alloys having a composition A to H, as shown in Table 1, respectively, were subjected to soaking and extrusion processing under the conditions I or III, as shown in Table 2, to perform a production test of the aluminum alloy extruded material samples 1 to 9. The extrusion was carried out with a single hollow die having a cross section of a square shape like a Japanese letter of "□" with each side of 100 mm and a thickness of 5 mm, by using a billet having a diameter of 255 mm and a length of 500 mm. After extrusion, the resultant extruded product was cooled at the exit side by a fan, and then it was subjected to aging treatment at 180° C. for 3 hours. Each of the obtained samples was subjected to a test and evaluation with respect to the following properties. The results are shown in Table 3.

The method of testing each property is as follows.

(1) Tensile Test (Tensile Strength, Proof Stress, and Elongation)

A tensile test was carried out, using a JIS No. 5 test specimen made of the sample, at a pulling speed of 10 mm/min, with an Instron-type tensile tester, to determine the tensile strength, the proof stress, and the elongation. The elongation was measured by drawing marking lines at an interval of 50 mm, and joining together after breaking.

In Table 3, the tensile strength, the proof stress, and the elongation value are represented by UTS, YTS, and E, respectively.

(2) Bending Processability

A V-shape bending at 90° (tip end R 2 mm) was carried out and, if cracking was not generated, it was evaluated as being good, and those in which cracking occurred were evaluated as being poor.

(3) Toughness (Charpy Value)

Use was made of a sub-size test specimen made of the sample, having a width of 5 mm and a U-notch of 2-mm in depth so that the extrusion direction would be parallel to the impact direction, and the Charpy value was measured according to JIS Z 2242.

(4) Amount of Adhesion of Zinc Phosphate (Chemical Conversion Treatment Property)

A test specimen made of the sample having a dimension of 5 mm×70 mm×150 mm was degreased at 43° C.×2 minutes with a degreasing agent (trade name: FC-L4460, manufactured by Nippon Parkerizing Co., Ltd.), and then it was treated at room temperature ×30 seconds with a surface adjusting agent (trade name: PL-4040, manufactured by Nippon Parkerizing Co., Ltd.), followed by a zinc phosphate treatment at 43° C.×2 minutes with a zinc phosphate treating agent (trade name: PB-L3020, manufactured by Nippon Parkerizing Co., Ltd.). After the treatments were finished, the resultant test specimen was washed with water and dried, to measure the adhering weight of the zinc phosphate precipitates per unit area.

(5) Spot Weldability

A spot welding was carried out at an applied pressure of 6000 N and a welding current of 34 kA, by using a 1%Cr—Cu R-type electrode tip (R=150 mm), with a single phase rectification welder.

The spot welding was carried out in the manner by maintaining the applied pressure for a predetermined period of time, during which the welding current was applied, a predetermined current was maintained for a predetermined period of time, and then the applied pressure was maintained until the nugget part of the material was completely solidified after the completion of application of the welding current.

Herein, the time (squeeze time) until the welding current rose after application of the applied pressure was set to be 35 cycles (0.70 second), the time (weld time) for maintaining the predetermined current value to melt the material was set to be 12 cycles (0.24 second), and the hold time (hold time) after the completion of the application of the current was set to be 15 cycles (0.30 second).

The welding was carried out at 1 spot/3 seconds, and, as a result, the point (number of striking) at which the tensile shear load became less than or equal to 5000 kN was evaluated as an electrode tip life.

(6) Fatigue Strength

A JIS-Z2275 No. 1 test specimen made of the sample was used, and a repeated bending test (R=−1) in both directions was carried out at 25 times per second, to measure the fatigue limit (fatigue strength at $10^7$ times).

TABLE 1

| | Alloy | Composition (wt %) | | | | | | | | | | GC*2 calculated value | Remarks |
|---|---|---|---|---|---|---|---|---|---|---|---|---|---|
| | | Cu | Fe | Si | Mn | Mg | Cr | Ti | Zn | Sr | Al | | |
| This invention | A | 0.62 | 0.8 | 3.2 | 0.5 | 0.16 | 0.02 | 0.02 | 1.2 | — | Balance | 1.19 | |
| | B | 0.63 | 0.82 | 3.2 | 0.45 | 0.27 | 0.05 | 0.02 | 0.9 | — | Balance | 1.26 | |
| | C | 0.59 | 0.78 | 3.1 | 0.52 | 0.25 | 0.07 | 0.01 | 2.4 | 100 ppm | Balance | 1.34 | Purified and refined from engine cast product scraps*1 |
| | D | 0.4 | 0.3 | 2.7 | 0.1 | 0.21 | 0.01 | 0.01 | 0.3 | — | Balance | 0.52 | |
| | E | 1.8 | 1.4 | 4.6 | 0.22 | 0.28 | 0.02 | 0.01 | 1.8 | — | Balance | 1.21 | Mixed Al ingot with engine cast product scraps*1 |
| Comparative examples | F | 0.63 | 0.85 | 3 | 0.46 | 0.5 | 0.06 | 0.02 | 1.1 | | Balance | 1.29 | |
| | G | 0.65 | 0.91 | 3.8 | 0.55 | 0.28 | 0.08 | 0.02 | 0.9 | — | Balance | 1.55 | |
| | H | 0.25 | 0.32 | 0.62 | 0.09 | 0.32 | 0.02 | 0.01 | 0.05 | — | Balance | 0.35 | |

(Note)

*1 Engine cast product scraps Si: 8 wt %

*2 Mn (wt %) + 0.32 × Fe (wt %) + 0.097 × Si (wt %) + 3.5 × Cr (wt %) + 2.9 × Ti (wt %)

TABLE 2

| | I | II | III | IV |
|---|---|---|---|---|
| Homogenizing treatment | 520° C. × 4 hours | | | |
| Extruding billet | 450° C. | | | |

TABLE 2-continued

| | I | II | III | IV |
|---|---|---|---|---|
| temperature | | | | |
| With or without die-cooling* | Without | Without | With | With |
| Extrusion speed | 20 mpm | 25 mpm | 30 mpm | 35 mpm |
| Extrusion state | Good | Cracking occurred | Good | Cracking occurred |

(Note)
*Die-cooling: The surface on the die-exit side was cooled with water mist (ordinary temperature) at a water amount of 500 ml/min.

made according to the method III in which the surface on the die-exit side was cooled by air mist, showed no generation of cracking, although the extrusion speed was higher than the method II, as shown in Table 2, and the good extruded material could be produced with a quite high productivity according to the method III.

Having described our invention as related to the present embodiments, it is our intention that the invention not be limited by any of the details of the description, unless otherwise specified, but rather be construed broadly within its spirit and scope as set out in the accompanying claims.

What we claim is:

1. An automotive structural member, such as a side frame, a rear frame, a center pillar, a side sill, and a floor frame, requiring spot weldability, surface treatment property, toughness, and fatigue strength, made from an extruded aluminum alloy, comprising 2.6 to 5 wt % of Si, 0.15 to 0.3 wt % of Mg, 0.3 to 2 wt % of Cu, 0.05 to 1 wt % of Mn, 0.2 to 1.5 wt % of Fe, 0.2 to 2.5 wt % of Zn, 0.005 to 0.1 wt % of Cr, 0.005 to 0.05 wt % of Ti, and 50 to 500 ppm Na, with the balance being made of aluminum and unavoidable impurities, and satisfying the relationship of the following expression (I):

$$(\text{Content of Mn (wt \%)})+0.32\times(\text{content of Fe (wt \%)})+0.097\times(\text{content of Si (wt \%)})+3.5\times(\text{content of Cr (wt\%)})+2.9\times(\text{content of Ti (wt \%)})\leqq 1.36.$$

2. An extruded material for an automotive structural member, such as a side frame, a rear frame, a center pillar, a side sill, and a floor frame, requiring spot weldability, surface treatment property, toughness, and fatigue strength, made from an extruded aluminum alloy, comprising 2.6 to 5 wt % of Si, 0.15 to 0.3 wt % of Mg, 0.3 to 2 wt % of Cu, 0.05 to 1 wt % of Mn, 0.2 to 1.5 wt % of Fe, 0.2 to 2.5 wt % of Zn, 0.005 to 0.1 wt % of Cr, 0.005 to 0.05 wt % of Ti, and 50 to 500 ppm Na, with the balance being made of aluminum and unavoidable impurities, and satisfying the relationship of the following expression (I):

$$(\text{Content of Mn (wt \%)})+0.32\times(\text{content of Fe (wt \%)})+0.097\times(\text{content of Si (wt \%)})+3.5\times(\text{content of Cr (wt \%)})+2.9\times(\text{content of Ti (wt \%)})\leqq 1.36.$$

3. The extruded material for an automotive structure member according to claim 2, wherein Ti is contained in the range of 0.005 and 0.01 wt %.

* * * * *

TABLE 3

| | Examples according to this invention | | | | | | Comparative examples | | |
|---|---|---|---|---|---|---|---|---|---|
| Sample No. | 1 | 2 | 3 | 4 | 5 | 6 | 7 | 8 | 9 |
| Alloy | A | A | B | C | D | E | F | G | H |
| Production method | III | I | III | III | III | III | I | III | III |
| UTS (MPa) | 267 | 276 | 295 | 292 | 278 | 311 | 205 | 387 | 311 |
| YTS (MPa) | 190 | 195 | 209 | 201 | 198 | 221 | 123 | 277 | 221 |
| E (%) | 16.5 | 15.5 | 15.9 | 16.2 | 15.8 | 14.1 | 14.2 | 10.3 | 9.5 |
| Bending processability | Good | Good | Good | Good | Good | Good | Poor | Poor | Good |
| Charpy value (J/cm$^2$) | 32 | 30 | 29 | 29 | 30 | 28 | 19 | 18 | 35 |
| Adhering amount of zinc phosphate (g/m$^2$) | 2.19 | 2.15 | 2.16 | 2.52 | 2.13 | 2.46 | 2.11 | 2.21 | 1.55 |
| Electrode life at the time of spot welding (number struck) | 630 | 640 | 640 | 720 | 620 | 700 | 680 | 660 | 420 |
| Fatigue strength (MPa) ($10^7$) | 102 | 110 | 115 | 109 | 106 | 120 | 65 | 122 | 112 |

As is apparent from the results shown in Table 3, the comparative sample 7 having too much Mg had a poor bending processability and had a quite low toughness and fatigue strength. In the comparative sample 9 having too little Cu, Si, and Zn and having too much Mg, the amount of adhering zinc phosphate indicating the surface treatment property was very small, and the electrode tip life at the time of spot welding was also quite short. The comparative sample 8 having a content of each element within the range defined in the present invention but failing to satisfy the relationship of expression (I) also had a poor bending processability and had a quite low toughness indicated by the Charpy value.

Contrary to the above, the samples 1 to 6 of the examples according to the present invention were excellent in tensile strength, proof stress, and elongation, and had excellently high bending processability, toughness, and fatigue strength. Further, regarding the samples 1 to 6 according to the present invention, the adhering amount of zinc phosphate indicating the surface treatment property showed a value of not less than 1.87 g/m$^2$, which means that the samples 1 to 6 were extremely excellent in surface treatment property. In addition, it can be understood that with respect to the samples 1 to 6 according to the present invention, the electrode tip life at the spot welding time was sufficiently very long, and the wear and loss of the electrode tip was quite small.

Example 2

Each sample, having the same shape as the one made in Example 1, was made by extrusion processing under the same conditions as in Example 1, by means of the production methods I to IV, respectively, as shown in Table 2, and using the alloy having the composition B, as shown in Table 1. On inspecting the extruded state, the sample that was